US005868390A

United States Patent [19]

Ripley

[11] Patent Number: 5,868,390

[45] Date of Patent: Feb. 9, 1999

[54] GAME BOARD AND METHOD OF MANUFACTURE

[76] Inventor: David R. Ripley, 3333 E. Broadway, Suite 1212, Bismark, N. Dak. 58501

[21] Appl. No.: 735,216

[22] Filed: Oct. 22, 1996

Related U.S. Application Data

[60] Provisional application No. 60/005,805 Oct. 23, 1995.

[51] Int. Cl.[6] ..... A63F 3/00

[52] U.S. Cl. ..... 273/287

[58] Field of Search ..... 273/243, 287, 273/249, 260, 261

[56] References Cited

U.S. PATENT DOCUMENTS

| | | | |
|---|---|---|---|
| 219,280 | 9/1879 | Count . | |
| D. 238,957 | 2/1976 | Johnson . | |
| D. 267,078 | 11/1982 | Tawil . | |
| 517,348 | 3/1894 | Linderman . | |
| 705,873 | 7/1902 | Schinkel . | |
| 2,288,671 | 7/1942 | Batchelder . | |
| 2,384,040 | 9/1945 | Miller . | |
| 2,477,825 | 8/1949 | Richardson . | |
| 2,532,404 | 12/1950 | Jagger . | |
| 2,544,900 | 3/1951 | Saqui . | |
| 2,620,131 | 12/1952 | Melling . | |
| 3,722,461 | 3/1973 | Forman . | |
| 3,770,193 | 11/1973 | Sauter . | |
| 3,800,981 | 4/1974 | Zeller . | |
| 3,829,994 | 8/1974 | Dillon . | |
| 3,838,857 | 10/1974 | Busby | 273/287 |
| 3,863,928 | 2/1975 | Nelson | 273/287 |
| 3,930,652 | 1/1976 | Lapolice . | |
| 3,945,640 | 3/1976 | Denmark . | |
| 4,521,675 | 6/1985 | Yakich . | |
| 5,037,234 | 8/1991 | De Jong . | |
| 5,145,185 | 9/1992 | Yu et al. | 273/287 |
| 5,370,397 | 12/1994 | Miller et al. . | |
| 5,403,013 | 4/1995 | Gilbert | 273/287 |
| 5,407,206 | 4/1995 | Cohen . | |
| 5,498,005 | 3/1996 | Jacques | 273/287 X |

FOREIGN PATENT DOCUMENTS

| | | |
|---|---|---|
| 442 61 | 1/1962 | Pakistan . |

*Primary Examiner*—William E. Stoll
*Attorney, Agent, or Firm*—Head, Johnson and Kachigian

[57] ABSTRACT

A game board having a two panel construction and its method of manufacture. A front panel and back panel constructed from a single piece of wood form the foundation of the game board, the panels being of a complementary generally polygonal profile with a portion of the periphery of the panels being beveled to form a plurality of keys when mated. A number of edge pieces having keyways adapted to engage the keys function to hide seams, add strength, and eliminate end checking of wood grain. Some edge pieces may also operate as hidden doors, concealing special channels. The front and back panels are formed from a common hardwood source and are mated in a manner such that their grain patterns match, while their grain expansion characteristics are opposing. The front panel has a cut-out region designed especially to receive and snugly retain a complementary shaped playing surface component. The front panel may also have a second cut-out region positioned above a cavity formed between the front panel and the back panel when mated, such that game accessories residing in the cavity may be manipulated by the user. For example, a score counter may be mounted in the cavity. Rectangular cavities are also used to house and dispense game pieces.

24 Claims, 8 Drawing Sheets

GAME BOARD AND METHOD OF MANUFACTURE

CROSS REFERENCE TO RELATED APPLICATION

This application claims the benefit of prior filed copending U.S. provisional application Ser. No. 60/005,805.

BACKGROUND OF THE INVENTION

1. Technical Field

The present invention relates generally to game boards, and, more specifically, to the construction of collector quality game boards incorporating a uniquely designed housing and having distinctive mechanical features for, among other things, holding and dispensing loose playing pieces and keeping score.

2. Background

Games have been a tool of education, art and moral teaching as well as a form of recreation for thousands of years. There are claims that the first board games date back 7,000 years. The game of "senet" found in 1922 in the tomb of Pharaoh Tutankhamen is known to be from about 3000 B.C., and another game board found in Egypt has been dated at somewhere between 4000 to 3500 B.C.

Identifying the earliest dates, and even the country of origin, of ancient games is difficult because these games have evolved over the centuries. In many instances the modern successor bears little resemblance to its early ancestor. However, the origin of many games can be traced back to their original culture and continent. Thousands of games have been created over the centuries. Yet relatively few have survived the test of time. Not unlike the board games of today, many games of the past had periods of popularity that ranged from one year to ten years or more.

Classic board games are ones that have been played around the world in one form or another for generations. For example, "Manacala-type" games were played in Egypt and the area around the Red Sea, and are still popular around the world, especially in Africa. Checkers, called "Draughts" in England and in ancient times, dates back to the twelfth century. Chess was said to have originated either in India in A.D. 600 or China before A.D. 200. Backgammon, a modern variation of a game called "Tabula," goes back to the first century. Many of these early strategy games employed tactical maneuvers closely associated with warfare, the goal being to outmaneuver or outpace an opponent, or to trap an opponent's pieces or remove them from play.

In early American history most board games were based on games from Europe, although most of these games originated in Africa or the Orient hundreds and even thousands of years earlier. "Reversi" began as a game of annexation in England in the 1880's and was brought to the United States a few years thereafter. Eighty years later (1960's) this game won recognition under the name "Othello". "Mah-Jongg" had been a favorite game in China for centuries before it was introduced into this country around 1922. The game proved so popular and was so heavily imported under different names that in 1924 Congress declared that all imported sets had to be stamped with the name "Mah-Jongg." Another game introduced into the United Sates this century is "Pachesi" (Parcheesi). Pachesi is one of the most popular games in the world and is the national game of India, where it originated 1200 years ago. "Nine Men's Morris" is another board game that was also popular among many ancient civilizations. The oldest "Morris" board, dated around 1400 B.C., was found cut into roofing slabs at Kurna, Egypt. Interestingly enough, a Morris-type board was discovered in the ruins of an ancient Southwest American Indian village. Similarly, the game "Fox and Geese" dates back to the twelfth century with its origin probably in Iceland. Similar games have been discovered among ancient American Indians, the game pieces having been changed to represent a coyote and chickens.

History has shown that classic board games have broad appeal. They cross all gender and cultural barriers and transcend religious and political boundaries. Research has also shown that throughout history the popularity of board games has been largely determined by two factors: (1) awareness (awareness of its existence or its social, educational or religious value, awareness of its cost, or awareness of how to play the game or acquire it), and (2) quality (quality of construction, quality of play or quality of entertainment).

Today, board games still hold their appeal. Unfortunately, there are few quality board games manufactured. Board games today are, for the most part, made from printed card stock, plastic or laminates. Innovation and quality are practically nonexistent. Playing pieces and scoring features are typically stored loosely in their box or in a tray if the board folds to form its own box. The nostalgia, history and significance of the game is all but lost.

It is an object of this invention to promote interest in, and the playing of, historic games of chance and skill by providing classic board games which balance aesthetics, unique functionality and cost while evoking the nostalgic and entertainment value of each game.

SUMMARY OF THE INVENTION

According to the present invention, the foregoing and other objects and advantages are attained by a game board having a unique two panel construction. A front panel and back panel form the foundation of the game board, the panels being of a complementary generally polygonal profile with a portion of the periphery of the panels being beveled to form a plurality of keys when mated. A number of edge pieces having keyways adapted to engage the keys function to hide seams, add strength, and eliminate end checking of wood grain. Some edge pieces may also operate as hidden doors, concealing special channels.

The components to the game board are carefully machined and meticulously shaped from solid hardwoods, such as cherry, oak, mahogany, black walnut or rosewood. In accordance with one aspect of the invention, the front and back panels are formed from a common hardwood source and are mated in a manner such that their longitudinal grain patterns match, while their cross-grain expansion characteristics are opposing. This gives the aesthetic appearance that the game board is made of a solid piece of wood and provides structural support against warpage.

In accordance with another aspect of the invention, the front panel has a cut-out region designed especially to receive a complementary shaped playing surface component. The playing surface component, preferably covered in lambskin, is snugly retained in the cut-out region after assembly.

In accordance with a further aspect of the invention, the front panel has a cut-out region positioned above a cavity formed between the front panel and the back panel when mated, such that game accessories residing in the cavity may be manipulated by the user. For example, a score counter may be mounted in the cavity. The preferred score counter is mounted on a precision metal shaft, the shaft being attached to a miniature torque adapter. The torque adapter restricts the free movement of the score counter to provide for a smooth, controlled rotation. The score counter has a knurled wheel accessible through the cut-out region in the front panel.

Rectangular cavities are also used to house and dispense game pieces. For this purpose, a retention plank is positioned between the front panel and the back panel in the rectangular cavity. The retention plank is supported above the back panel by support springs and defines an accessory space between the plank and the front panel. Game accessories may be loaded or unloaded by the user into the accessory space through the front panel cut-out region. After they are loaded, the game accessories are retained between the plank and the front panel by the upward force of the spring supported plank. A "counter" (game piece) dispenser adapted to engage the retention plank forces it to compress toward the back panel to provide access to the accessory space for the loading or unloading of the game accessories. A slide mechanism is seated in the cavity to aid in unloading the game accessories. The slide mechanism has a tab accessible through the front cut-out region so that the user may manipulate the tab to move the slide mechanism within the cavity.

Interior hardwood parts are sealed with special penetrating oils to resist aging which can dry or warp fine woods. Movement of hardwood parts are aided by exotic waxes which lubricate close fitting components. Exterior hardwood surfaces are prepared with the finest stains and sealed with a durable lacquer finish which prohibits chipping, wear and fading.

Hereinbelow, alternate embodiments for the games of cribbage, backgammon and checkers are illustrated; but it must be understood that this is by example only. One of the unique features of the present invention is that it is adaptable to accommodate many different classic board games. Accordingly, a "generic" game board incorporating some of the features of the present invention is first shown and described.

The innovative structure of the present invention overcomes the malady of contemporary design.

Still other objects and advantages of the present invention will become readily apparent to those skilled in this art from the following detailed description, wherein there is shown and described only the preferred embodiments of the invention, simply by way of illustration of the best mode contemplated for carrying out the invention. As will be realized, the invention is capable of modifications in various obvious respects, all without departing from the invention. Accordingly, the description should be regarded as illustrative in nature, and not as restrictive.

DETAILED DESCRIPTION OF THE PREFERRED EMBODIMENT

Figure 1:
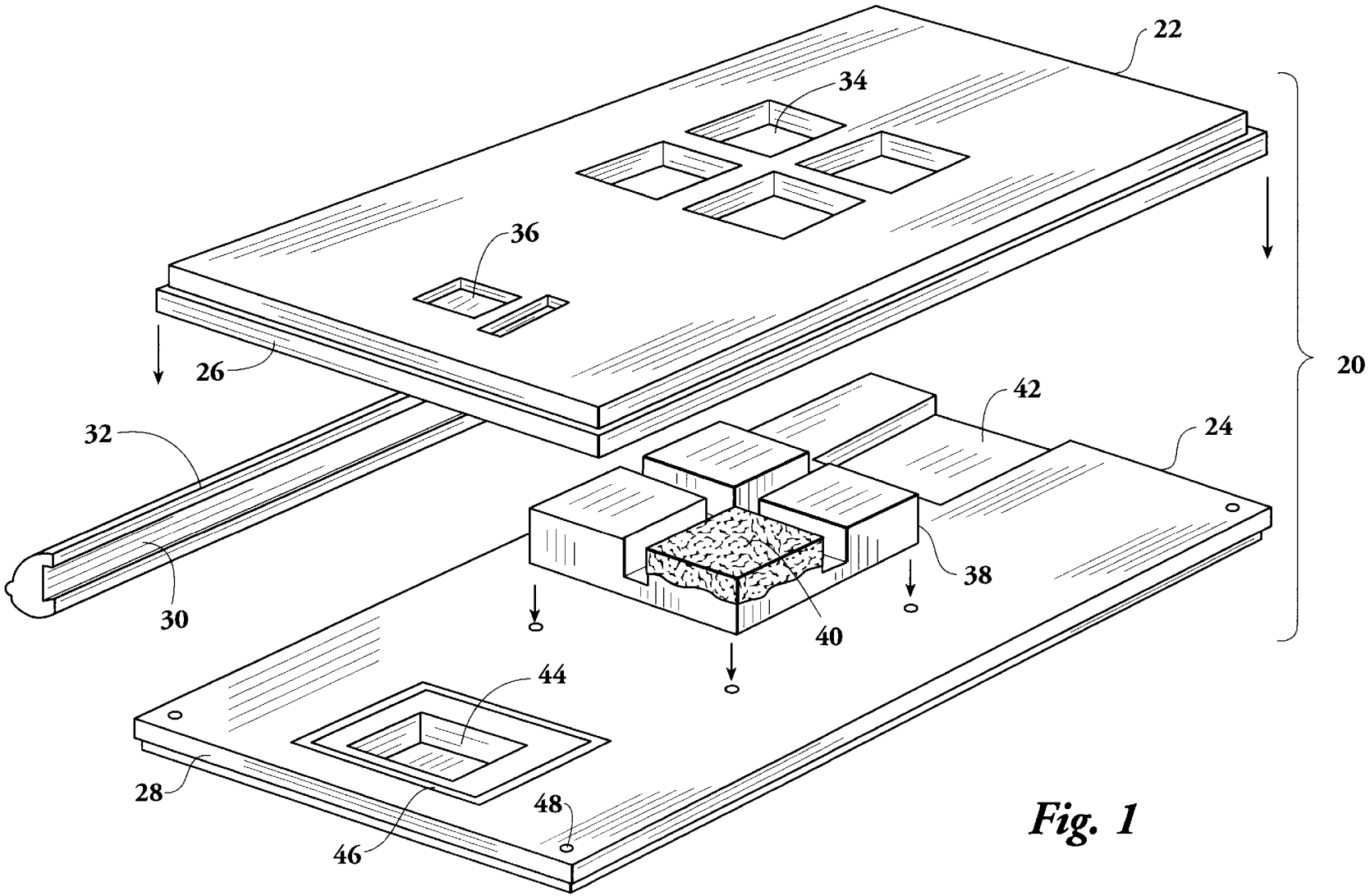
FIG. 1 is an exploded view of a generic game board constructed in accordance with the present invention.
Figure 2:
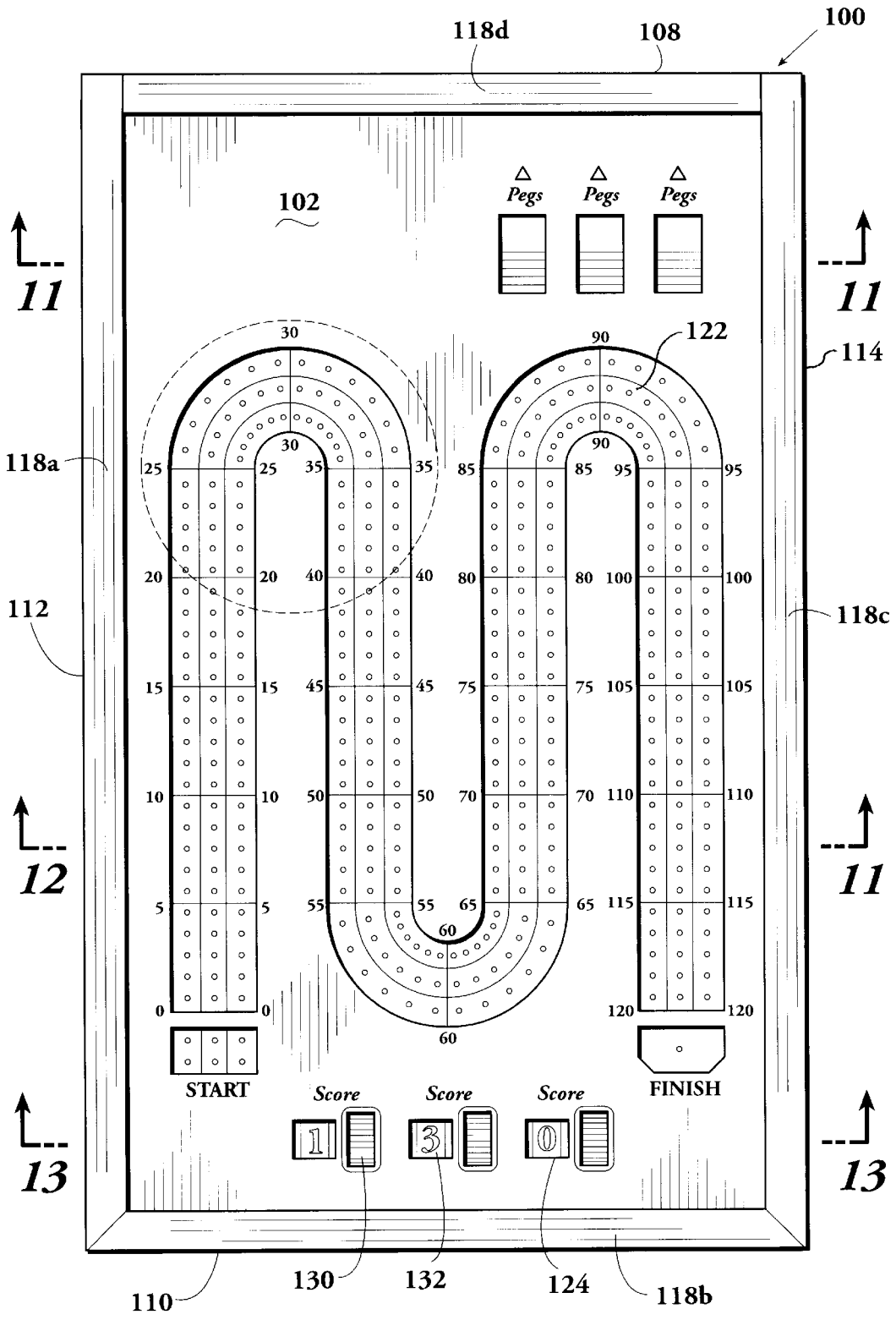
FIG. 2 is a top plan view of a cribbage board constructed in accordance with the present invention.
Figure 4:
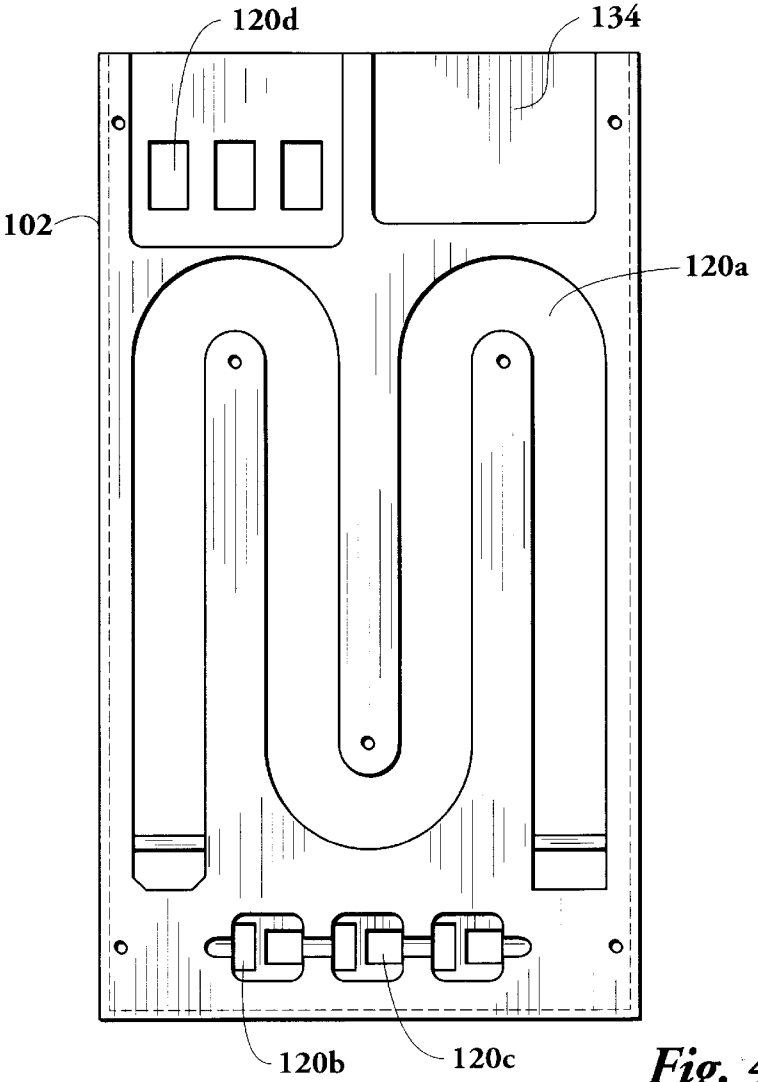
FIG. 4 is a plan view of the front panel interior of the cribbage board of FIG. 2.
Figure 3:
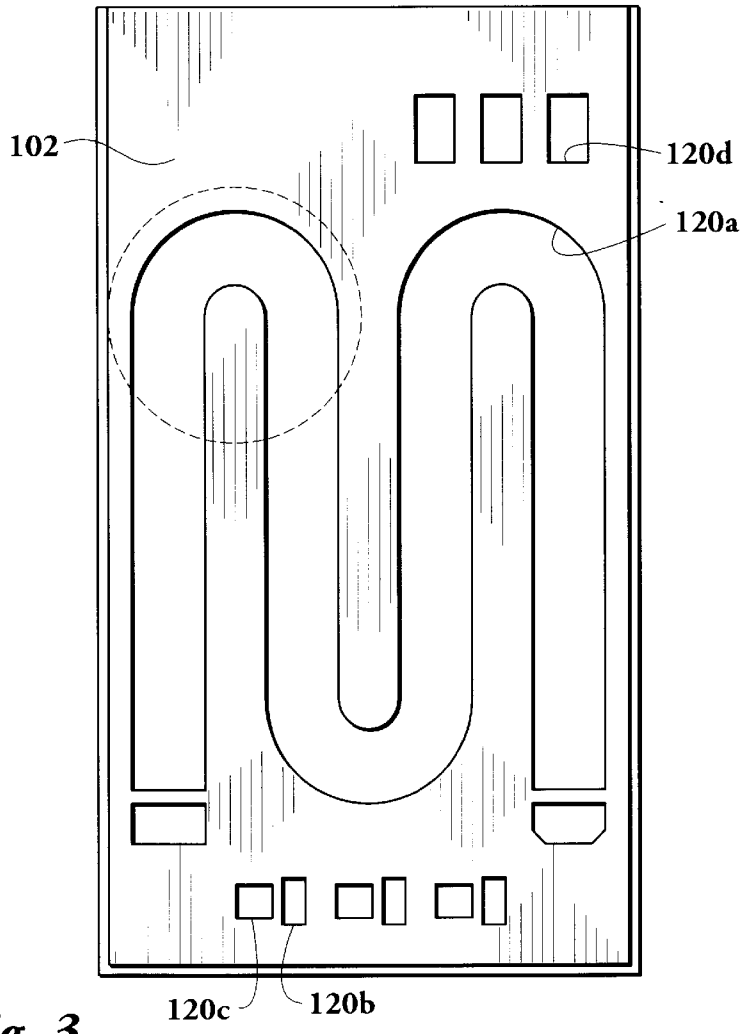
FIG. 3 is a plan view of the front panel exterior of the cribbage board of FIG. 2.
Figure 6:
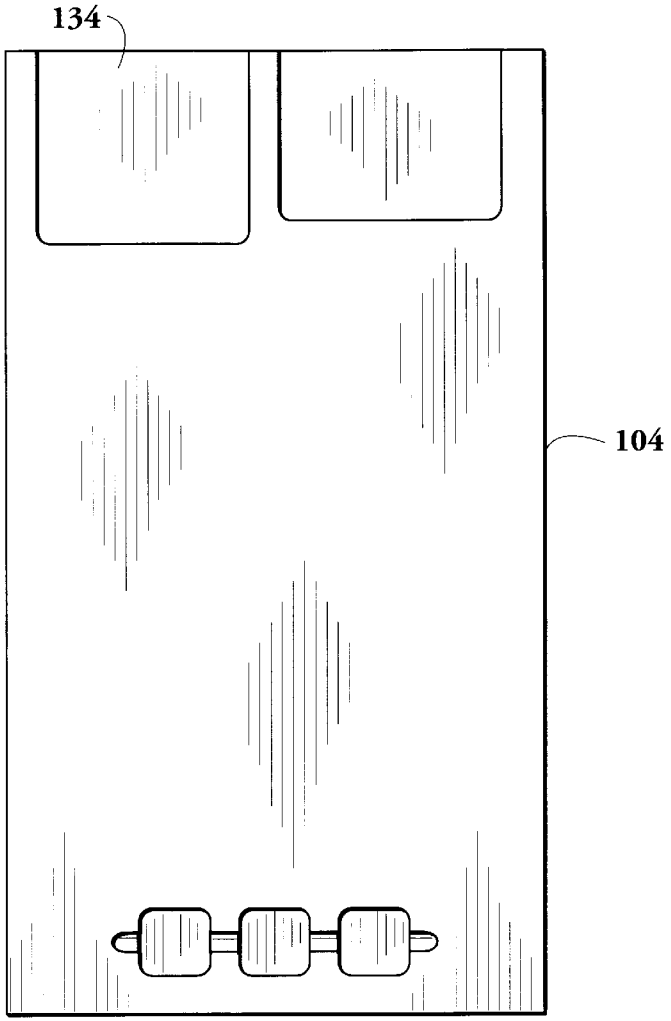
FIG. 6 is a plan view of the back panel interior of the cribbage board of FIG. 2.
Figure 5:
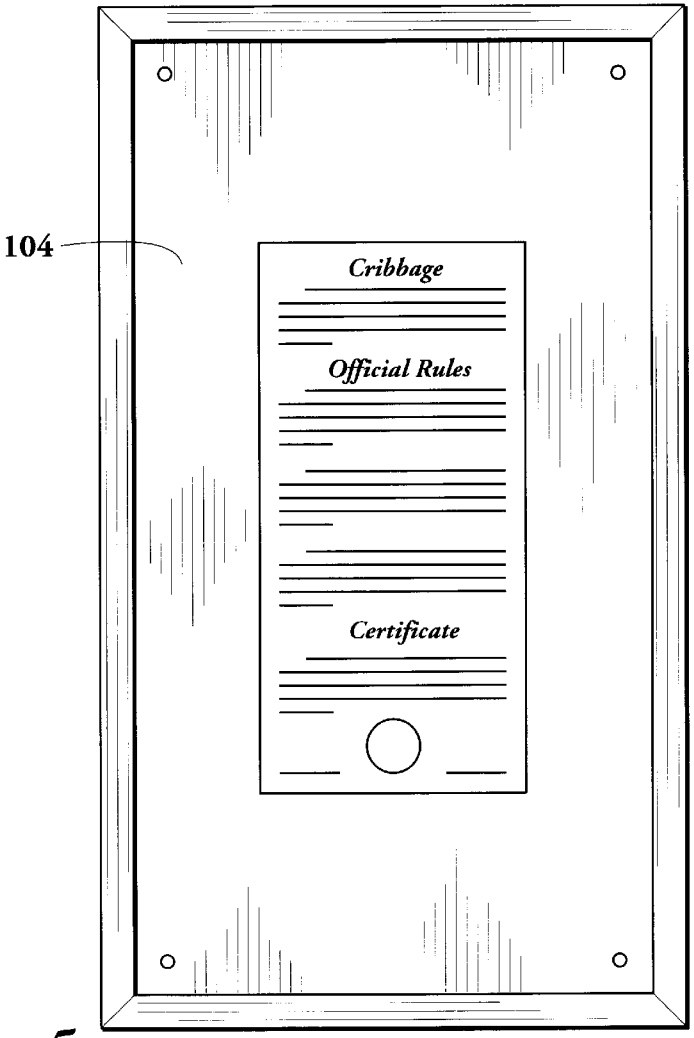
FIG. 5 is a plan view of the back panel exterior of the cribbage board of FIG. 2.
Figure 7:
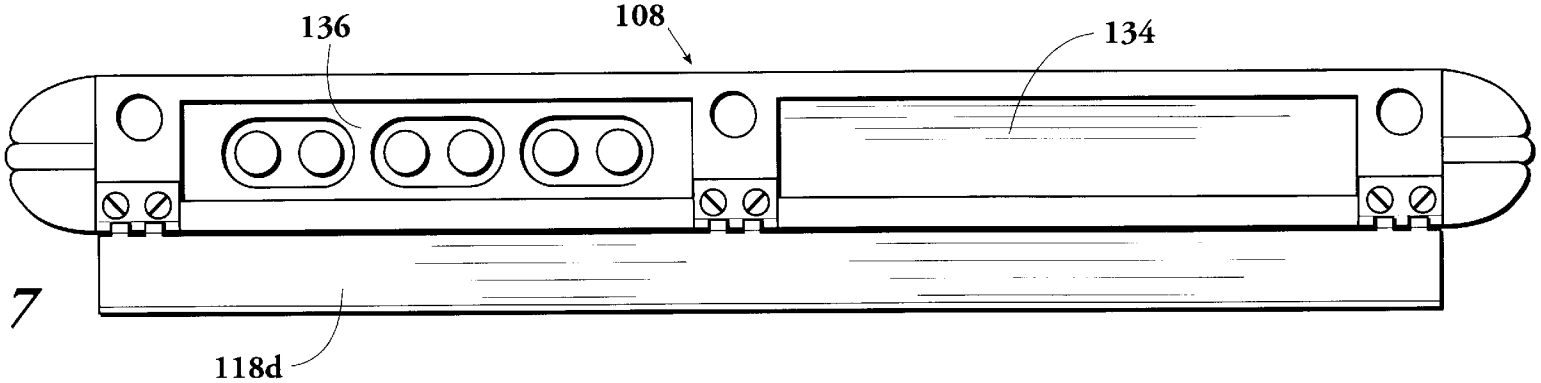
FIG. 7 is an edge view of the top edge of the cribbage board of FIG. 2.
Figure 8:
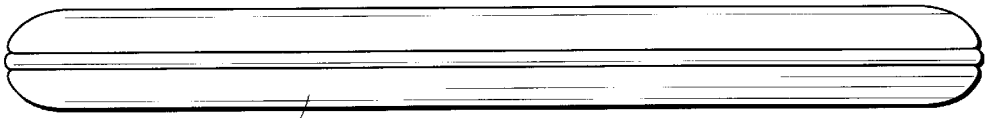
FIG. 8 is an edge view of the bottom edge of the cribbage board of FIG. 2.
Figure 9:
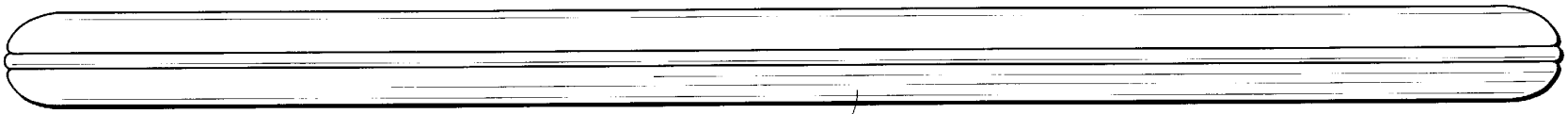
FIG. 9 is an edge view of the left edge of the cribbage board of FIG. 2.
Figure 10:
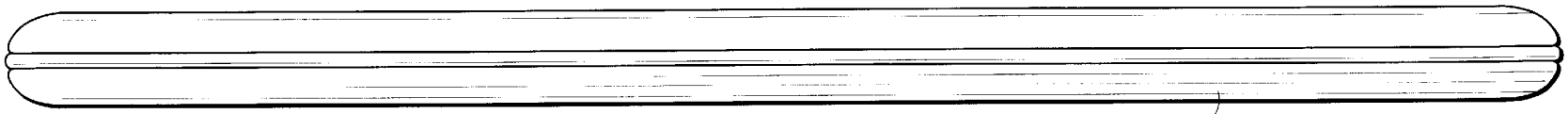
FIG. 10 is an edge view of the right edge of the cribbage board of FIG. 2.
Figure 11:
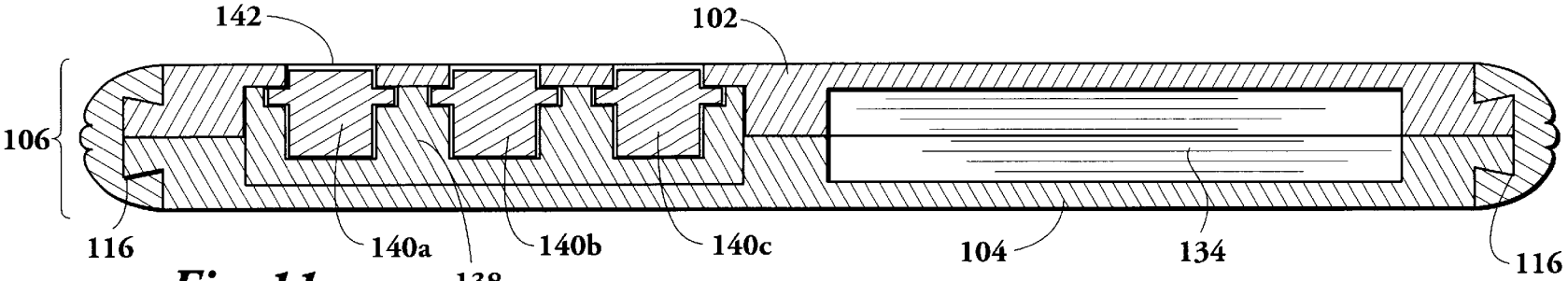
FIG. 11 is a cross section taken along line 11—11 of FIG. 2.
Figure 12:
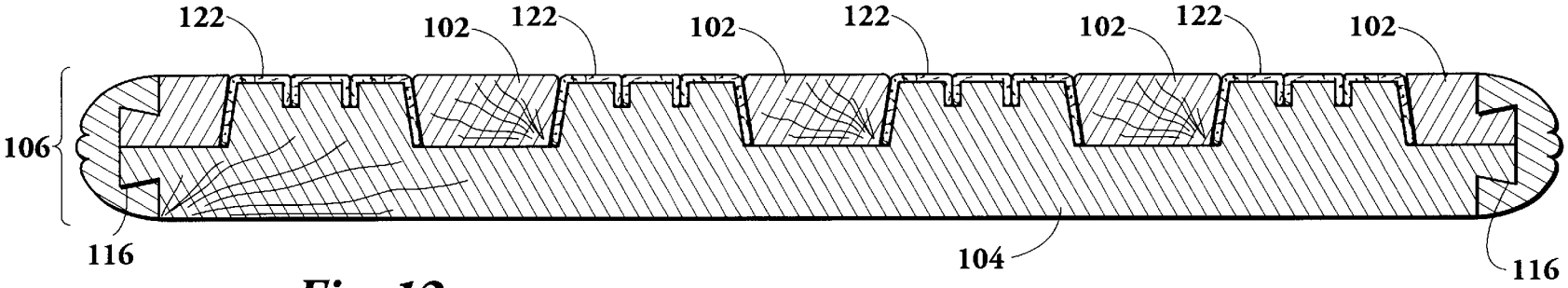
FIG. 12 is a cross section taken along line 12—12 of FIG. 2.
Figure 13:
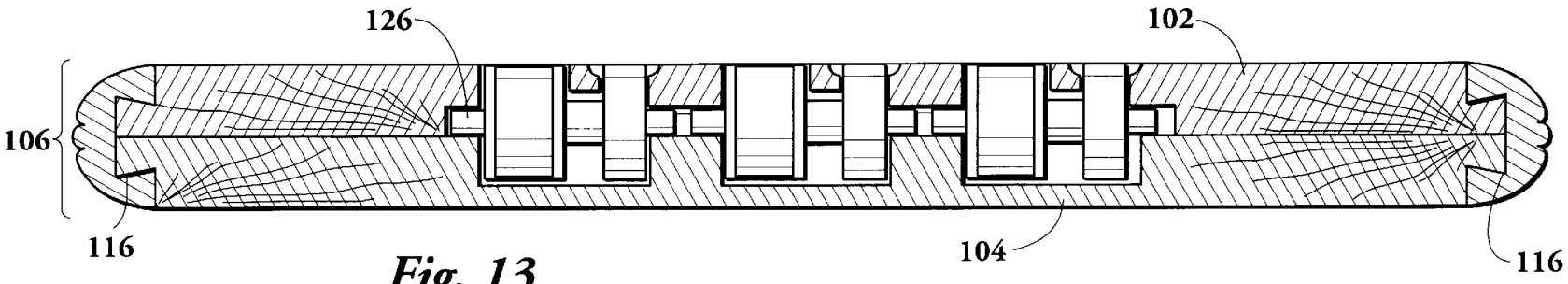
FIG. 13 is a cross section taken along line 13—13 of FIG. 2.

Turning to FIG. 1, a "generic" game board constructed in accordance with the present invention is generally indicated by the reference numeral 20. The game board 20 has a polygonal shaped (in this case rectangular) front (or top) panel 22 and a complementary sized and shaped rectangular back (or bottom) panel 24. The periphery of the front panel 22 and the back panel 24 is beveled 26, 28 such as to form, when the panels are mated, a number of keys for engagement with keyways 30 provided in edge pieces or molding 32. The edge pieces 32 hide seams, add strength, and eliminate end checking of wood grain. Some edge pieces 32 may also operate as hidden doors.

Preferably, the front panel 22 and back panel 24 are formed from a common hardwood source. The panels 22, 24 are then mated such that their longitudinal grain patterns match. In other words, the panels 22, 24 are arranged so that the grain of the top panel 22 runs parallel to that of the bottom panel 24. Still further, the panels 22, 24 are oriented such that the grain expansion characteristics of the front panel 22 and the back panel 24 are opposing. This is accomplished by mating the panels 22, 24 so that the cross grain pattern of the front panel 22 is the mirror image of the cross grain pattern of the back panel 24. This arrangement aides in preventing warpage; and, in fact, the game board 20 will tighten as a result of any such warpage.

The front panel 22 is further provided with one or more cut-out regions 34, 36. The cut-out region identified by reference numeral 34 is adapted to overlay a playing surface component 38. The playing surface component 38 is shaped such that it occupies cut-out region 34 when the game board 20 is assembled. A leather or lambskin covering 40 covers the playing surface component 38. When assembled, the upper most portion of the playing surface component 38 is preferably flush with the exterior of the front panel 22.

There is also provided in accordance with the invention one or more channels 42 and cavities 44. For purposes of this application, a channel 42 can be said to be a three sided enclosure formed between the front panel 22 and the back panel 24, insofar as the enclosure is accessible from the periphery of the game board 20 via an opening hidden by an edge piece 32. This is in contrast to a cavity 44, which can be said to have four sides, being accessible only through a cut-out region 36 in the front panel 22. A channel 42 may be used to hold game accessories, such as a deck of playing cards, or devices for dispensing game accessories. A cavity 44 may similarly be used to hold and dispense game accessories, or it may house, for example, a score counter to be manipulated by the user. The score counter or other game accessory would be accessible through its associated front panel cut-out region 36.

Around the cavity 44 is shown a glue trap 46. The glue trap 46 is preferably a one-eighth (⅛) inch moat surrounding the cavity 44. The glue trap insures that the cavity 44 will remain free of impediments that might obstruct the manipulation of game accessories contained therein. The glue trap 46 also prevents glue from squeezing out into critical areas. Thus, the glue is controlled so as not to unduly spread along the interior of the game board 20 during assembly.

A plurality of alignment holes 48 are provided on the interior of the front panel 22 and back panel 24 to aid in mating the panels and seating other component parts of the invention, such as the playing surface component 38.

Now turning to an exemplary embodiment, FIGS. 2–13 disclose the preferred embodiment of a cribbage game manufactured in accordance with the present invention. The cribbage board, generally indicated by the reference numeral 100, is of a two panel construction. The cribbage board 100 has a rectangular front panel 102 and a complementary sized rectangular back panel 104 designed for mating, and forming, when mated, a housing 106. The housing 106 may be further defined as having a top edge 108, a bottom edge 110, and two side edges (left edge 112, right edge 114). The periphery of the front panel 102 and the back panel 104 are beveled about the two side edges, 112, 114 and the bottom edge 110 such that when the front panel 102 and the back panel 104 are mated, the bottom edge 110 and the side edges 112, 114 form keys 116 for engagement with three edge pieces 118*a–c*. The keys 116 may be formed as dove-tailed keys, a box hinge, or of any other suitable shape. The three edge pieces 118*a–c* have keyways complementary to the keys 116 for engagement with the keys 116. The top edge 108 of the housing 106 is also provided with an edge piece 118*d*, but in the form of a hinged, hidden door. A number of acceptable hinge types may be used, but a double pivot friction hinge is preferred. The front panel 102 of housing 106 is further provided with a plurality of cut-out regions 120*a–d*.

A playing surface component 122 is overlaid and secured by the front panel 102 when assembled in a way such that an upper portion of the playing surface component 122 occupies cut-out region 120*a*. It is preferred that the upper portion of the playing surface component 122 be flush with the exterior of the front panel 102.

A plurality of score counters 124 are mounted on precision metal shafts 126 in a plurality of cavities 128 formed between the front panel 102 and the back panel 104 near the bottom edge 110 of the housing 106. The metal shafts 126 are attached to miniature torque adapters (not shown) to control the rotation of the score counters 124. A knurled wheel 130 is accessible to the user through cut-out region 120*b*. Cut-out region 120*c* allows the user to see scoring indicia 132 located on the score counters 124.

The cribbage board 100 also includes a playing card compartment 134 formed as a channel and located between the front panel 102 and the back panel 104 beneath the top edge 108 of the housing 106. The playing card compartment 134 is sized to store a standard deck of playing cards. The compartment is accessible to the user by opening the hinged, hidden door 118*d*.

A peg holder and dispenser 136 is placed in a second channel formed between the front panel 102 and back panel 104 beneath top edge 108. The peg holder and dispenser 136 comprises a compartment slide retainer 138 and a plurality of slide mechanisms 140*a–c*. The slide mechanisms 140*a–c* each has a knurled tab 142 accessible through a cut-out region 120*d* so as to be manipulated by the user to eject a peg (not shown) from the slide retainer 138 when the hidden door 118*d* is opened. The slide retainer 138 may be further defined in relation to the housing 106 as having a top end and a bottom end. A cross bar (not shown) is horizontally affixed across the bottom end and a plurality of springs (not shown) are adapted to attach at their first ends to the cross bar and at their second ends to the slide mechanisms 140*a–c*.

Figure 14:
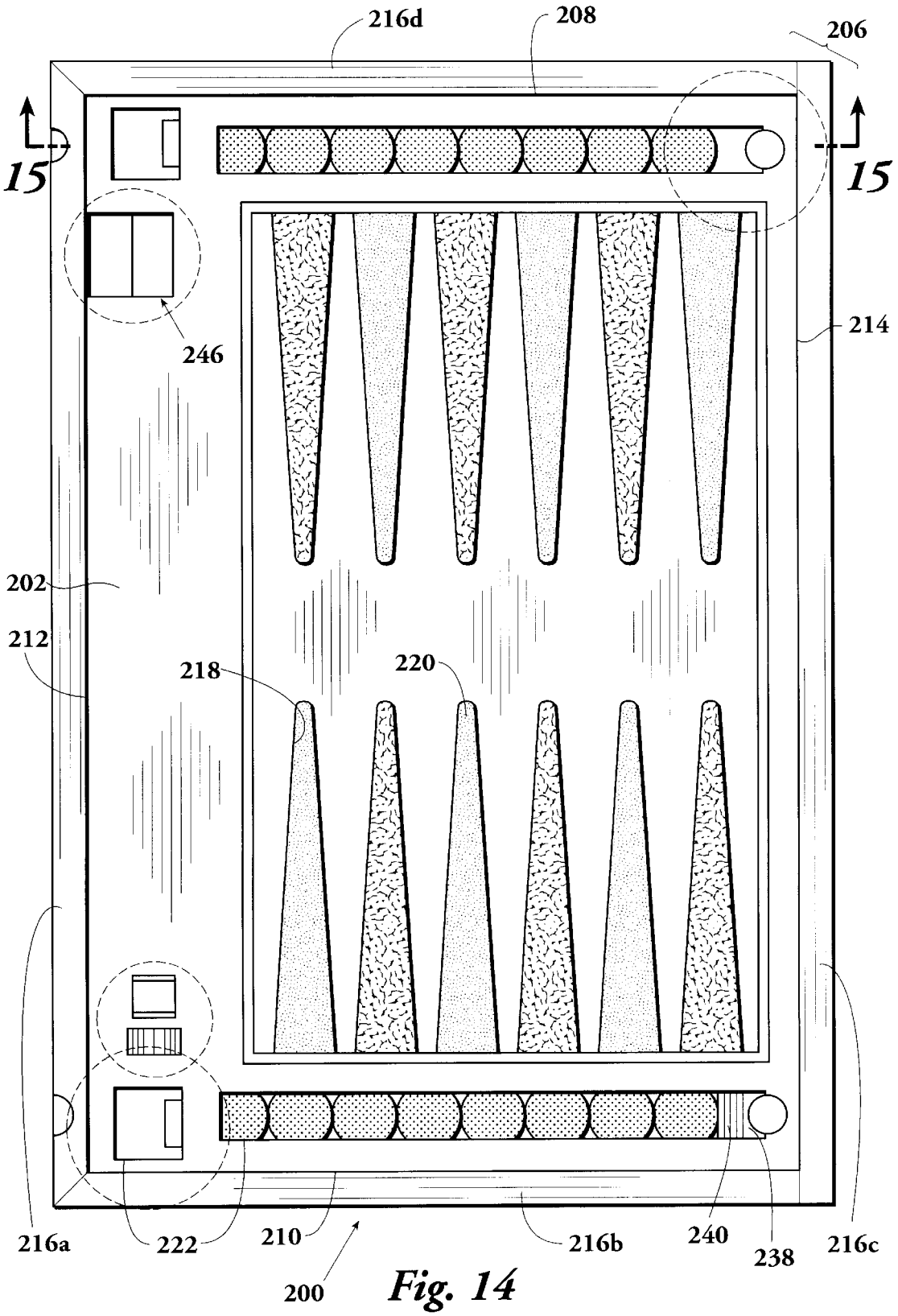
FIG. 14 is a top plan view of a backgammon board constructed in accordance with the present invention.
Figure 15:
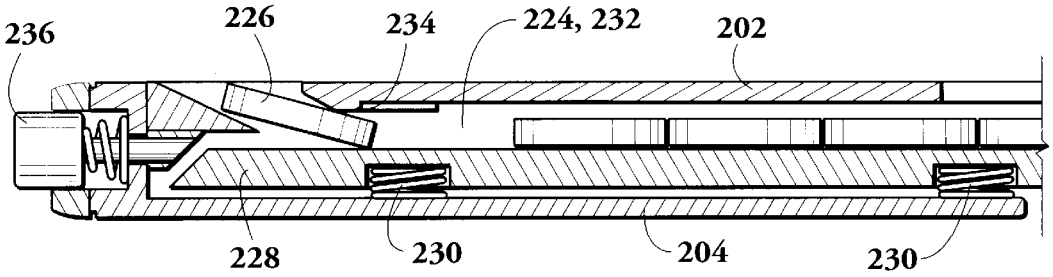
FIG. 15 is a cross section taken along lines 15—15 of FIG. 14.

A backgammon board constructed in accordance with the present invention is illustrated in FIGS. 14–15. The backgammon board 200 like the cribbage board 100 is composed of a rectangular front panel 202 and a complementary sized and shaped back panel 204. The front panel 202 and back panel 204 are designed for mating and forming, when mated, a housing 206. The housing 206 has a top edge 208, a bottom edge 210 and two side edges (left 212, right 214).

Unlike the cribbage board 100, the backgammon board has no hidden door. Instead, the entire periphery of front panel 202 and back panel 204 is beveled such that, when mated, the edges form keys for engagement with four edge pieces 216*a–d*.

The front panel 202 has a first cut-out region 218 for receiving a playing surface component 220, the playing surface component 220 being overlaid and secured by the front panel 202 such that an upper portion of the playing surface component 220 occupies the first cut-out region 218. A second cut-out region 222 is positioned above a rectangular-shaped cavity 224 formed between the front panel 202 and the back panel 204 when mated. Game accessories 226 may be loaded and unloaded from the cavity 224 by the user.

To manage the game accessories 226, a retention plank 228 is positioned in cavity 224 between the front panel 202 and the back panel 204. The retention plank 228 is supported above back panel 204 by at least one support spring 230. The area between the retention plank 228 and the underside of front panel 202 is defined as an accessory space 232. The game accessories 226 may be loaded or unloaded by a user into accessory space 232 through the second cut-out region 222. When loaded, the game accessories are secured for storage and transportation between the plank 228 and the front panel 202.

To aid in preventing the game accessories 226 from inadvertently exiting the accessory space 232, an interior area of the underside of front panel 202 is provided with a lip 234.

A counter dispenser 236 is adapted to engage the retention plank 228 when pushed inwardly, forcing the plank 228 to compress toward back panel 204 to provide access to accessory space 232 for the loading or unloading of the game accessories 226.

To aid in unloading the game accessories 226, a slide mechanism 238 may be seated in the cavity 224. The preferred slide mechanism has a tab 240 accessible through the second cut-out region 222 such that the user may manipulate tab 240 to move the slide mechanism toward the loading/unloading point 242.

The backgammon board 200 may also be provided with a score counter 244 as described hereinabove. Further accessory spaces, such as a dice holder 246 may be provided.

Figure 16:
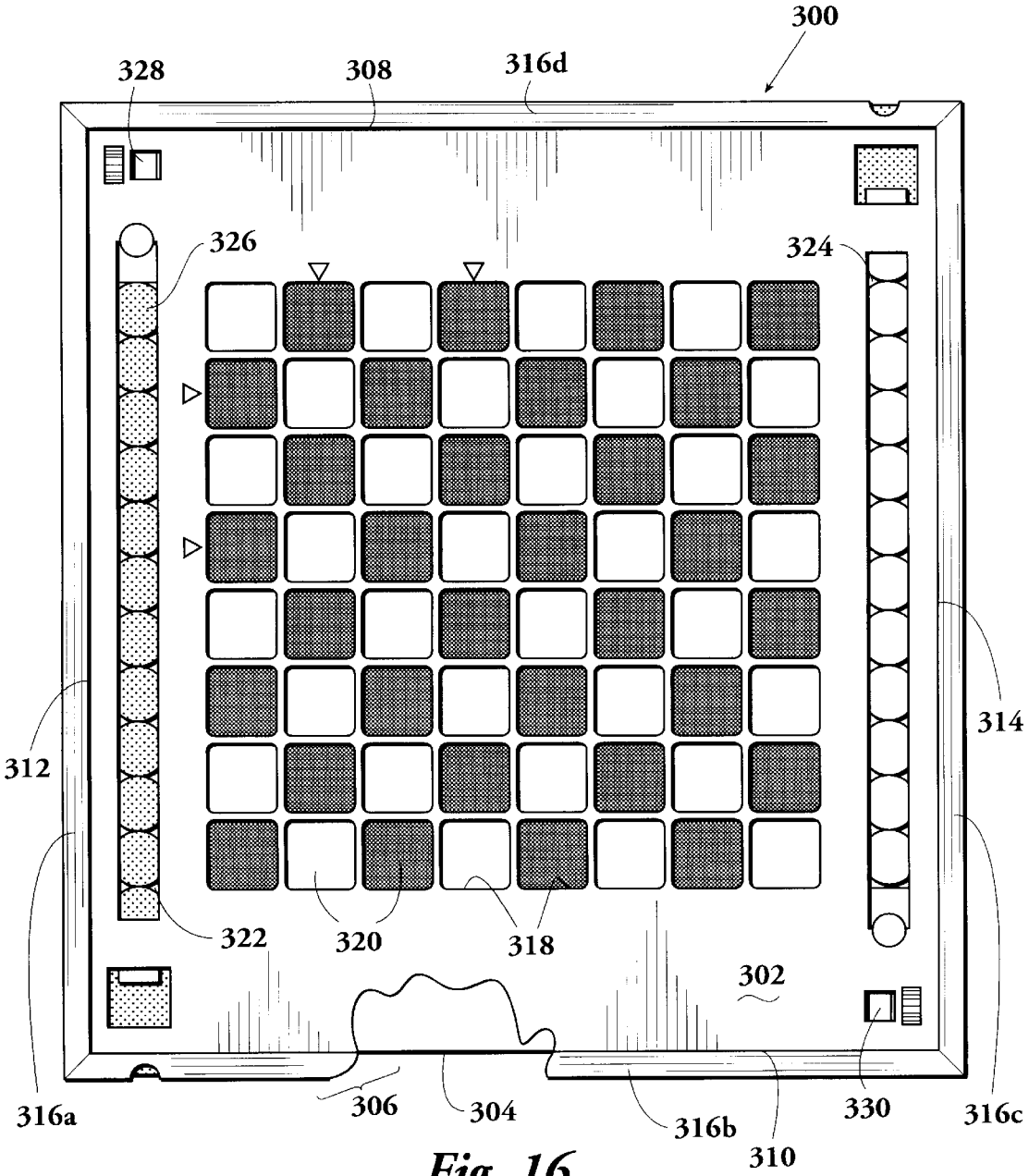
FIG. 16 is a top plan view of a checker board constructed in accordance with the present invention.

A preferred checkerboard is illustrated in FIG. 16. It is very similar in construction to the preferred backgammon board 200. The checkerboard 300 includes a square front panel 302 and a complementary sized and shaped back panel 304. When mated, a housing 306 is formed. A top edge 308, a bottom edge 310, and two side edges (left 312, right 314) define the periphery of the housing 306. Like the other game boards, four edge pieces 316*a–d* are provided for engagement with keys formed by beveling the periphery of the front panel 302 and back panel 304.

The front panel 302 has a first cut-out region 318 in which is received a playing surface component 320. Cavities 322, 324 are provided for holding and dispensing game accessories 326 as heretofore described in connection with the backgammon board 200. Similarly, score counters 328, 330 are provided.

Again, it should be understood that cribbage board 100, backgammon board 200 and checkerboard 300 are merely exemplary products of the present invention. A wide variety of classic board games may be constructed utilizing the invention.

The game board of the present invention is manufactured from a single, pre-sized, solid piece of hardwood panel. The pre-sized panel will vary in dimension and shape for different game embodiments; however, the general technique used to manufacture the various game board embodiments is the same.

Several advantages are obtained by using a single, solid panel or wood piece for forming both the front and back panels. One advantage is that all machining of the wood piece necessary to form channels, cavities and other component parts of the invention can be performed in a single operation. But the most important advantage obtained is that the single wood piece can be worked and the game board assembled in such a way that the longitudinal grain patterns of the front and back panel match and run parallel, while the cross-grain patterns are opposing. In other words, the manufacturing process makes it possible to easily arrange the front and back panels so that the grain of the front panel runs parallel to that of the back panel. Still further, the manufacturing process allows for the panels to be oriented such that the grain expansion characteristics of the front panel and the back panel are opposing. This is accomplished by mating the panels so that the cross grain pattern of the front panel is the mirror image of the cross grain pattern of the back panel. This gives the assembled game board the appearance of a solid piece of wood, even though it is of a two-panel construction, and at the same time strengthens the game board structurally, as the peculiar arrangement of the cross-grain patterns prevents warpage.

The manufacturing technique utilized to convert a single, solid wood piece into a front and back panel and associated components also provides advantages over other conventional wood working techniques in efficiency and cost.

To begin the manufacturing process, the single, solid wood piece is oriented so that its most attractive grain side faces down. The wood piece is thereafter held in place by vacuum clamps. Vacuum clamps are used throughout the machining process to avoid damaging what will become the external surfaces of the game board. After the wood piece is vacuum clamped to a machining table, a router bit (preferably a ¼ inch bit) is moved width-wise across the grain through the center of the wood piece to demarcate what will become the front and back panels. The wood piece, however, is not completely penetrated by the router bit. Rather, the router is set to leave a 1/16 inch skin on the most attractive grain side of the wood piece. A 1/16 inch skin is also left on the external face of all cut-out areas and components machined into the wood piece.

This feature of leaving a 1/16 inch skin on the external side of the wood piece allows for the use of vacuum clamps throughout the manufacturing process and further functions prevent aesthetic damage to the wood piece such as normally occurs by sawing or plunge routing. This avoids the "blow out" and chipping common in normal routing or drilling processes. Routing only partially through the wood piece also avoids chatter across the grain normally encountered during curved cuts.

All machining occurs on the inside of the single, solid wood piece, i.e. what will become the interior of the completed board. Again, a 1/16 inch skin is left on the external (or outside) face of the wood piece during the machining process.

After all machining is performed on what will be the interior portions of the front and back panels, the 1/16 inch skin covering on the exterior of the panel is sanded off. During the sanding process the individual components of the invention, including the front and back panels, are released. After the machining and sanding is completed, the boards are deburred and prepared for further processing. The two panels release by the sanding will eventually be "folded" or "flipped" so that their inside surfaces mate. Thus the longitudinal grain pattern on both panels will match, while the cross grain characteristics are opposing, i.e. the cross grain pattern of the front panel will be the mirror image of the cross grain pattern of the back panel.

The periphery of the front and back panels are routed to form keys for mating with complimentary keyways on edge pieces. The edge pieces are separately provided. They are bought in length and cut to size, with their interior routed to correspond to the shape of the keys routed onto the edges of the front and back panels.

Though not a necessary step, any imperfections in the wood or grain may be removed by dewiskering the grain with a solution of water and alcohol. This dewiskering raises or cracks the grain so that all imperfections can be seen prior to staining. This process also prevents the grain from rising during staining. After the wood is dewiskered it is again sanded. Then the edge pieces are put on to insure that the game board will have a proper fit. Afterwards, the game board is taken apart and stained. A sealer coat is put on, such as a self-sealing lacquer. Then graphics are applied, followed by two more coats of lacquer. The wood is then sanded again and a final coat of lacquer is applied. Final assembly follows.

Leather is applied to the playing surface component by cutting the leather into appropriate pieces and then applying the leather to the upper surface of the playing surface component with double stick adhesive.

While the invention has been described with a certain degree of particularity, it is manifest that many changes may be made in the method hereinabove described without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A multi-panel wooden game board having an internal cavity or channel, the game board being formed from a single wood piece so that the assembled game board resists warpage, has the appearance of a single, solid piece of wood and is otherwise aesthetically pleasing, comprising:

(a) a front panel formed from a first portion of the wood piece;

(b) a back panel formed from a second portion of the wood piece;

(c) a playing surface component; the front panel having a cut-out region corresponding to the shape of the playing surface component such that when the front panel is mated with the back panel the playing surface component is snugly retained in the cut-out region;

(d) at least one cavity or channel formed between the front and back panels when the panels are mated; and (e) the front and back panels having a periphery, the panels being mated about the periphery by edge pieces, whereby the edge pieces hide seams and eliminate end checking of wood grain on the periphery.

2. The game board according to claim 1, wherein the front panel and the back panel are mated in an arrangement such that the longitudinal grain pattern of the front panel runs parallel to that of the back panel, while the cross grain patterns of the front panel and the back panel are opposing.

3. The game board according to claim 1, wherein the front panel and the back panel are of a complementary generally polygonal profile with a portion of the periphery of the panels being beveled to form a plurality of keys when mated and wherein the edge pieces have keyways adapted to engage the keys.

4. The game board according to claim 1, wherein at least one of the edge pieces functions as a hidden door for accessing the channel.

5. The game board according to claim 4, further comprising a slide retainer and slide mechanism for storing and dispensing game pieces placed in the channel between the front panel and the back panel, the slide mechanism having a tab accessible through an opening in the front panel so as to be manipulated by a user to eject a game piece from the slide retainer when the hidden door is open.

6. The game board according to claim 1, further comprising a game accessory residing in the cavity or channel.

7. The game board according to claim 6, wherein the game accessory is a score counter mounted in the cavity.

8. The game board according to claim 7, wherein the score counter has a knurled wheel accessible through a second cut-out region in the front panel so as to be manipulated by a user.

9. The game board according to claim 1, further comprising a retention plank positioned in the cavity between the front panel and the back panel, the retention plank being supported above the back panel by at least one support spring and defining an accessory space between the plank and the front panel, such that game pieces may be loaded or unloaded by a user into the accessory space through the cut-out region, the game pieces, when loaded, being secured between the plank and the front panel.

10. The game board according to claim 9, wherein an interior portion of the front panel is provided with a lip so as to aid in preventing the game pieces from exiting the accessory space when loaded.

11. The game board according to claim 9, further comprising a counter dispenser adapted to engage the retention plank, forcing the plank to compress toward the back panel, to provide access to the accessory space for the loading or unloading of the game pieces.

12. The game board according to claim 11, further comprising a slide mechanism seated in the cavity, the slide mechanism having a tab accessible through the cut-out region such that a user may manipulate the tab to move the slide mechanism to aid in unloading the game pieces.

13. A cribbage board, comprising:

a rectangular front panel and a complementary sized rectangular back panel designed for mating and forming, when mated, a housing for the cribbage board, the housing being further defined as having a top edge, a bottom edge, and two side edges, a portion of a periphery of the front and back panels being beveled such that when mated the bottom edge and the side edges form keys for engagement with three edge pieces having complementary keyways, the top edge of the housing being provided with a hinged, hidden door, and the front panel further having a first, a second, and a third cut-out region, the front panel and the back panel being mated in a manner such that the grain of the front panel runs parallel to that of the back panel, while the cross grain pattern of the front panel is the mirror image of the cross grain pattern of the back panel;

a playing surface component overlaid and secured by the front panel such that an upper portion of the playing surface component occupies the first cut-out region;

a plurality of score counters mounted in a plurality of cavities between the front panel and the back panel near the bottom edge, the score counters having a knurled wheel accessible through the second cut-out region so as to be manipulated by a user;

a playing card compartment formed as a first channel between the front panel and the back panel beneath the top edge for storing a deck of playing cards, the compartment being accessible to the user by opening the hidden door; and a peg holder and dispenser placed in a second channel between the front panel and the back panel beneath the top edge, the peg holder and dispenser comprising a compartmented slide retainer and a plurality of slide mechanisms, the slide mechanisms having a knurled tab accessible through the third cut-out region so as to be manipulated by a user to eject a peg from the slide retainer when the hidden door is open.

14. A backgammon board, comprising:

a rectangular front panel and a complementary sized and shaped back panel designed for mating and forming, when mated, a housing for the backgammon board, the front panel and the back panel being mated in a manner such that the grain of the front panel runs parallel to that of the back panel, while the cross grain pattern of the front panel is the mirror image of the cross grain pattern of the back panel, the housing being further defined as having a top edge, a bottom edge, and two side edges, a periphery of the front and back panels being beveled such that when mated the edges form keys for engagement with four edge pieces, the front panel further having a first cut-out region for receiving a playing surface component, the playing surface component being overlaid and secured by the front panel such that an upper portion of the playing surface component occupies the first cut-out region, and a second cut-out region positioned above a cavity formed between the front panel and the back panel when the panels are mated, such that game pieces residing in the cavity may be manipulated by a user; and a retention plank positioned in the cavity between the front panel and the back panel, the retention plank being supported above the back panel by at least one support spring and defining an accessory space between the plank and the front panel, such that the game pieces may be loaded or unloaded by a user into the accessory space through the second cut-out region, the game pieces, when loaded, being secured between the plank and the front panel.

15. A checker board, comprising:

a square front panel and a complementary sized and shaped back panel designed for mating and forming, when mated, a housing for the checker board, the front panel and the back panel being mated in a manner such that the grain of the front panel runs parallel to that of the back panel, while the cross grain pattern of the front panel is the mirror image of the cross grain pattern of the back panel, the housing being further defined as having a top edge, a bottom edge, and two side edges, a periphery of the front and back panels being beveled such that when mated the edges form keys for engagement with four edge pieces, the front panel further having a first cut-out region for receiving a playing surface component, the playing surface component being overlaid and secured by the front panel such that an upper portion of the playing surface component occupies the first cut-out region, and a second cut-out region positioned above a cavity formed between the front panel and the back panel when the panels are mated, such that game pieces residing in the cavity may be manipulated by a user; and a retention plank positioned in the cavity between the front panel and the back panel, the retention plank being supported above the back panel by at least one support spring and defining an accessory space between the plank and the front panel, such that the game pieces may be loaded or unloaded by a user into the accessory space through the second cut-out region, the game pieces, when loaded, being secured between the plank and the front panel.

16. The checker board according to claim 15, further comprising a score counter mounted in a second cavity, the score counter having a knurled wheel accessible through a third cut-out region in the front panel so as to be manipulated by a user.

17. A two-panel game board having an internal cavity or channel, the game board having the appearance of a single, solid piece of material and otherwise appearing aesthetically pleasing, comprising:

(a) a front panel formed from a first portion of the material;

(b) a back panel formed from a second portion of the material;

(c) a playing surface component; the front panel having a cut-out region corresponding to the shape of the playing surface component such that when the front panel is mated with the back panel the playing surface component is snugly retained in the cut-out region;

(d) at least one cavity or channel formed between the front and back panels when the panels are mated; and (e) the front and back panels having a periphery, the panels being mated about the periphery by edge pieces, whereby the edge pieces hide seams and eliminate end checking of the material around the periphery of the game board.

18. A method of manufacturing a multi-panel wooden game board having a cut-out area and an internal cavity or channel from a single wood piece so that the assembled game board resists warpage, has the appearance of a single, solid piece of wood and is otherwise aesthetically pleasing, comprising:

(a) selecting a single wood piece, the wood piece having a grain pattern and a most attractive grain side;

(b) securing the wood piece on a machining table so that the most attractive grain side faces down;

(c) moving a router bit width-wise across the grain through the center of the wood piece on the side opposite the most attractive grain side to demarcate what will be a front panel and a back panel, the wood piece not being completely penetrated by the router bit, but rather a thin skin being left on the most attractive grain side;

(d) machining the side opposite the most attractive grain side with the router bit to form what will become the cut-out area and interior cavity or channel when the game board is assembled, a thin skin also being left on the most attractive grain side in what will be the cut-out areas;

(e) after all machining has been performed, sanding the most attractive grain side so as to remove the thin skin thereby releasing the front panel, the back panel and any cut-out pieces; and (f) mating the front and back panels to form the game board by folding and securing the panels together such that the longitudinal grain pattern of the panels match while the cross grain pattern of the panels are opposing, whereby the game board resists warpage and has the appearance of single, solid piece of wood.

19. The method according to claim 18 wherein the thin skin is about 1/16 inch in thickness.

20. The method according to claim 18 wherein the router bit is a 1/4 inch bit.

21. The method according to claim 18 wherein the wood piece is secured upon the machining table by vacuum clamps.

22. The method according to claim 18 further comprising routing the periphery of the front and back panels to form keys and mating the panels with a plurality of edge pieces having keyways complimentary to the keys.

23. The method according to claim 18 further comprising inserting a playing surface component formed to correspond to the cut-out areas between the front and back panels.

24. The method according to claim 18 further comprising inserting game accessories into the interior cavity or channel.

* * * * *